US010215520B1

(12) United States Patent
Liu

(10) Patent No.: US 10,215,520 B1
(45) Date of Patent: Feb. 26, 2019

(54) SAFETY DEVICE FOR CROSSBOWS

(71) Applicant: Chi-Chang Liu, Taichung (TW)

(72) Inventor: Chi-Chang Liu, Taichung (TW)

(73) Assignee: POE LANG ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 16/043,118

(22) Filed: Jul. 23, 2018

(51) Int. Cl.
*F41B 5/12* (2006.01)

(52) U.S. Cl.
CPC ..... *F41B 5/12* (2013.01)

(58) Field of Classification Search
CPC ..... F41B 5/12
See application file for complete search history.

(56) References Cited

U.S. PATENT DOCUMENTS 4,192,281 A * 3/1980 King ..... F41B 5/1469 124/25
6,736,123 B1 * 5/2004 Summers ..... F41A 17/46 124/25
6,802,304 B1 * 10/2004 Chang ..... F41B 5/1469 124/25
7,588,022 B2 * 9/2009 Chang ..... F41B 5/123 124/25
7,770,567 B1 * 8/2010 Yehle ..... F41A 17/46 124/25
2014/0182574 A1 * 7/2014 Darlington ..... F41A 17/56 124/35.1

* cited by examiner

*Primary Examiner* — John Ricci

(57) ABSTRACT

A safety device connected to a shooting device or a crossbow includes a safety member that is moved to restrict an activating member from pivoting to prevent unintentionally shooting when replacing arrows at the ready-to-shoot status of the crossbow. A resilient member is used to pull the transmission plate to move toward the second end of a case of the crossbow to deactivate the restriction to the positioning member such that the positioning member pivots and protrudes beyond a notch of the case to stop the shooting action of the string. After a new arrow is positioned, the safety member is moved again to drive the transmission plate from the second end to the first end of the case, and the activating member is released from restriction and the arrow is ready to shoot.

6 Claims, 11 Drawing Sheets

SAFETY DEVICE FOR CROSSBOWS

BACKGROUND OF THE INVENTION

1. Fields of the Invention

The present invention relates to a safety device, and more particularly, to a safety device for a crossbow and the safety device allows arrow replacement before shooting.

2. Descriptions of Related Art

The conventional safety device for a crossbow is designed to prevent from unexpectedly shooting. When the string is pulled and set, the users may pull the trigger so that the energy stored in the pulled string sends an arrow by the stored energy while the string bounces forward. The safety device has to be deactivated such that the trigger can be pulled to shoot. It is noted that the crossbows can be used to shoot the arrows of different sizes and lengths according to practical needs. When the users decide to change a different arrow while the string is pulled and set at the ready-to-shoot position, the safety device has to be deactivated again, however, the positioning member of the safety device is stilled restricted due to no shooting action happened. Therefore, the string is possible to bounce forward to either send the arrow out or to injure the user's hand.

The present invention is intended to provide a safety device of a crossbow that is designed to prevent the string to bounce forward during replacement of arrows.

SUMMARY OF THE INVENTION

The present invention relates to a safety device connected to a shooting device of a crossbow, and comprises a case having first end, a second end and a bottom connected between the first and second ends. The case further includes a room defined therein, and a notch is defined in the first end and communicates with the room. Two elongate holes are respectively defined through two walls of the case and communicate with the room. An opening is defined in the bottom and communicates with the room. A shooting unit is located in the room and includes an activating member, a shooting member, a safety member, a transmission plate, a resilient member and a positioning member. The activating member is pivotably located in the room and has the first end thereof protruding beyond the opening. The shooting member is pivotably located in the room and pivotable to contact the second end of the activating member. A gap is formed between the activating member and the shooting member when the shooting member is not pivoted. The safety member has two protrusions which respectively extend beyond the elongate holes of the case.

The transmission plate is slidably located in the room and partially located beneath the shooting member. The transmission plate is moved by movement of the safety member. The transmission plate has a passage defined transversely through the first end thereof. The resilient member has the first end thereof hooked to the passage, and the second end of the resilient member is connected to a rod extending from inside of the room. The positioning member is located in the room and beside the notch. The positioning member is not pivotable to form a ready-to-shoot mode when the transmission plate moves toward the positioning member. The positioning member is pivoted and protrudes beyond the notch when the transmission plate moves away from the positioning member. The safety member moves toward the first end of the case and pushes the transmission plate to move so as to pull the resilient member to store energy.

When changing arrows during that the shooting device is in the ready-to-shoot mode, the safety member is moved toward the second end of the case, and the transmission plate deactivates restriction to the safety member and moves toward the second end of the case by the resilient member so that the transmission plate deactivates restriction to the positioning member, and the positioning member pivots toward the notch to prevent a string from bouncing forward.

Preferably, the case includes a first part and a second part which is connected to the first part. The second part includes a recess in which the transmission plate is slidably received.

Preferably, the transmission plate includes a front section, a rear section and a middle section formed between the front and rear sections. The front section includes a shoulder which restricts the positioning member to pivot. The passage is defined through the rear section. The middle section includes at least one push plate extending from the top thereof. One of the protrusions of the safety member pushes the at least one push plate, and a displacement between the safety member and the transmission plate is able to set the ready-to-shoot mode or to deactivate the ready-to-shoot mode. The safety member moves toward the second end of the case and the resilient member pulls the transmission plate so as to pivot the positioning member such that a portion of the positioning member protrudes beyond the notch to restrict the string from bouncing forward.

Preferably, the positioning member has the first end thereof pivotably connected to the inside of the room. The second end of the positioning member has a bar transversely connected thereto. The bar and the transmission plate are located on the same side with regarding to the safety member. A recovery spring is biased between inside of the room and the underside of the positioning member. When the transmission plate moves toward the positioning member, the bar is engaged with the shoulder. The positioning member compresses the recovery spring to store energy. When the transmission plate moves toward the safety member, the positioning member does not compress the recovery spring which then pushes the positioning member so that a portion of the positioning member protrudes beyond the notch.

Preferably, the shooting member includes a first hook, a second hook and a push portion. The first hook partially protrudes beyond the notch so as to hook the string at the ready-to-shoot mode. The second hook contacts a restriction end of the activating member to restrict the shooting member from pivoting when the shooting member is pivoted to restrict the string. The push portion is located above the safety member. A spring is biased between the push portion and inside of the room. The spring pivots the shooting member.

Preferably, the activating member has the restriction end on the first end thereof and a push end on the second end thereof. A connection end is formed between the restriction end and the push end. A block protrudes from the inside of the room. A distance is formed between the block and the push end. The block includes a bore, and a restriction spring 5 has the first end thereof resiliently engaged with the bore, and the second end of the restriction spring contacts the push end. When the safety member moves toward the second end of the case and covers up the bore, the activating member is restricted from pivoting. The connection end is pivotably connected with a link which is pivotably connected with a trigger. When the trigger is pulled, the link drives the activating member to pivot.

The present invention will become more obvious from the following description when taken in connection with the accompanying drawings which show, for purposes of illustration only, a preferred embodiment in accordance with the present invention.

BRIEF DESCRIPTION OF TUE DRAWINGS

DETAILED DESCRIPTION OF THE PREFERRED EMBODIMENT

Figure 1:
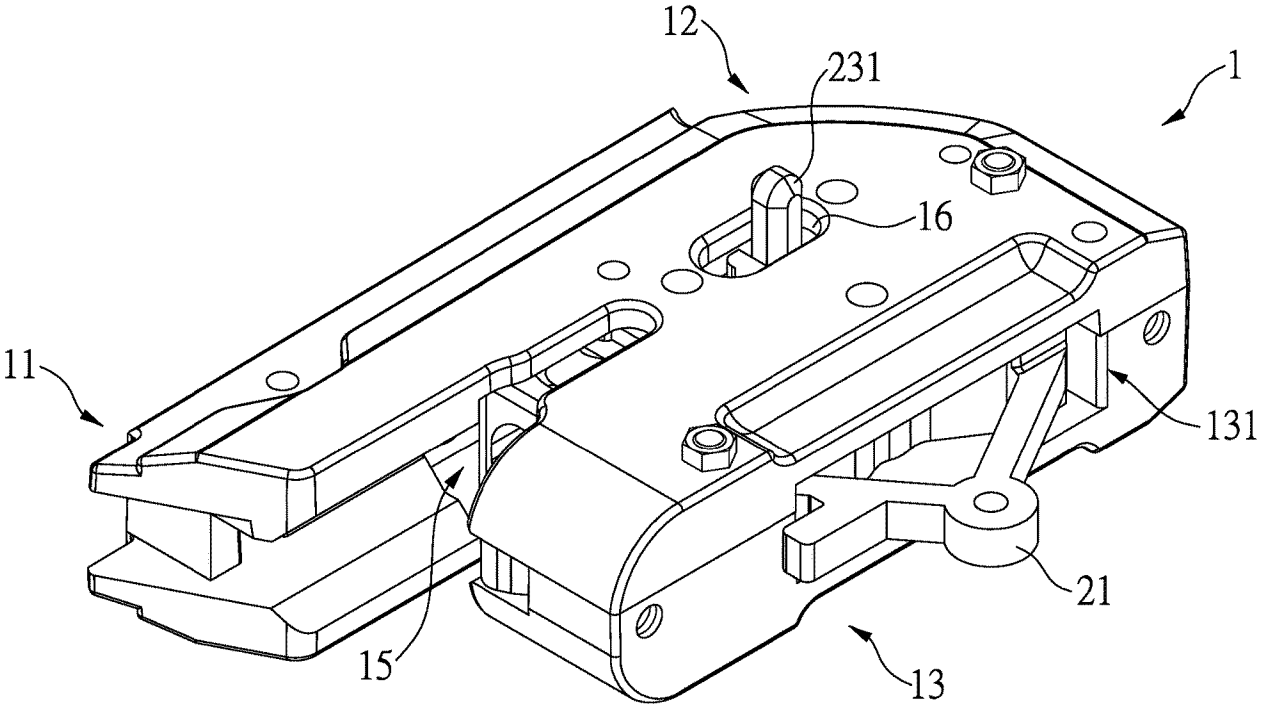
FIG. 1 is a perspective view to show the safety device of the present invention.

Referring to FIGS. 1 to 11, the safety device connected to a shooting device 20 of a crossbow 10 of the present invention comprises a case 1 having a first end 11, a second end 12 and a bottom 13, wherein the bottom 13 is connected between the first and second ends 11, 12. A room 14 is defined in the case 1. A notch 15 is defined in the first end 11 and communicating with the room 14. The notch 15 extends from the first end 11 toward the second end 12. Two elongate holes 16 are respectively defined through two walls of the case 1 and communicate with the room 14. An opening 131 is defined in the bottom 13 and communicates with the room 14. A shooting unit 2 is located in the room 14 so as to secure/shoot the arrow 40 via the string 30. The shooting unit 2 includes an activating member 21, a shooting member 22, a safety member 23, a transmission plate 24, a resilient member 25 and a positioning member 26. The activating member 21 is pivotably located in the room 14 and has a first end thereof protruding beyond the opening 131. The shooting member 22 is pivotably located in the room 14 and is located proximate to the notch 15. The shooting member 22 is pivotable to contact the second end of the activating member 21. When the shooting member 22 contacts the activating member 21, the shooting member 22 protrudes beyond the notch 15. A gap is formed between the activating member 21 and the shooting member 22 when the shooting member 22 is not pivoted, and the shooting member 22 does not protrude beyond the notch 15 at this status. The safety member 23 has two protrusions 21 which respectively extend beyond the elongate holes 16 of the case 1. The user may use the protrusions 21 to control the direction that the safety member 23 moves. The transmission plate 24 is slidably located in the room 14 and partially located beneath the shooting member 22. The transmission plate 24 is moved by movement of the safety member 23. The transmission plate 24 has a passage 241 defined transversely through the first end thereof. The resilient member 25 has the first end thereof hooked to the passage 241, and the second end of the resilient member 25 is connected to a rod 141 extending from inside of the room 14.

The positioning member 26 is located in the room 14 and beside the notch 15. The positioning member 26 is located corresponding to the position where the shooting member 22 protrudes beyond the notch 15. When the transmission plate 24 moves toward the positioning member 26, the positioning member 26 is not pivotable to form a ready-to-shoot mode. The positioning member 26 is pivoted and protrudes beyond the notch 15 when the transmission plate 24 moves away from the positioning member 26. The safety member 23 moves toward the first end 11 of the case 1 and pushes the transmission plate 24 to move so as to pull the resilient member 25 to store energy.

When changing arrows 40 under the situation that the shooting device 20 is in the ready-to-shoot mode, the safety member 23 is moved toward the second end 12 of the case again, the transmission plate 24 deactivates restriction to the safety member 23 and moves toward the second end 12 of the case 10 by the resilient member 25 so that the transmission plate 24 deactivates restriction to the positioning member 26. The positioning member 26 then pivots toward the notch 15 to prevent the string 30 from bouncing forward.

Figure 8:
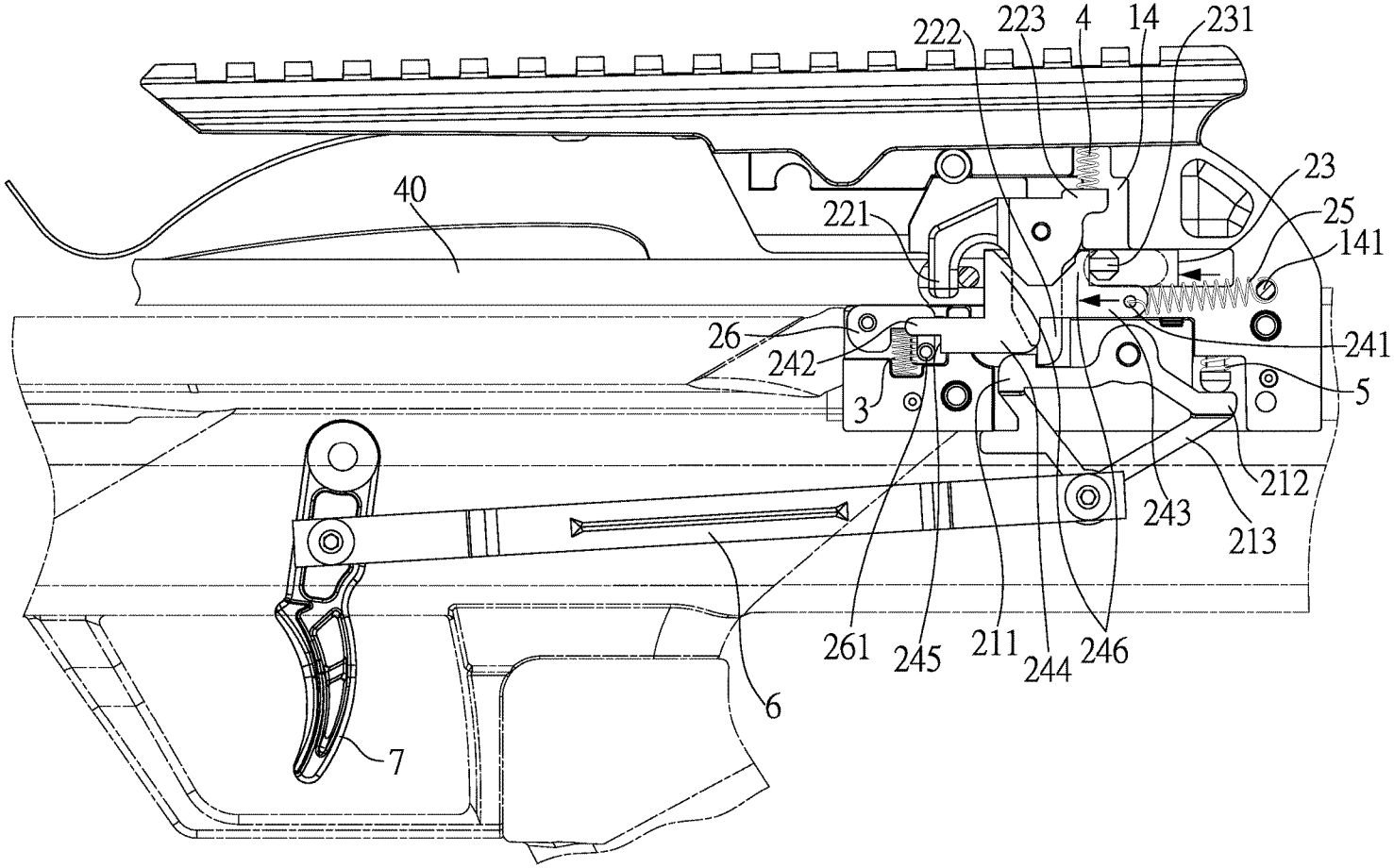
FIG. 8 shows that safety member is moved toward the first end of the case, and the transmission plate is moved to restrict the positioning member from pivoting to form the ready-to-shoot mode.
Figure 9:
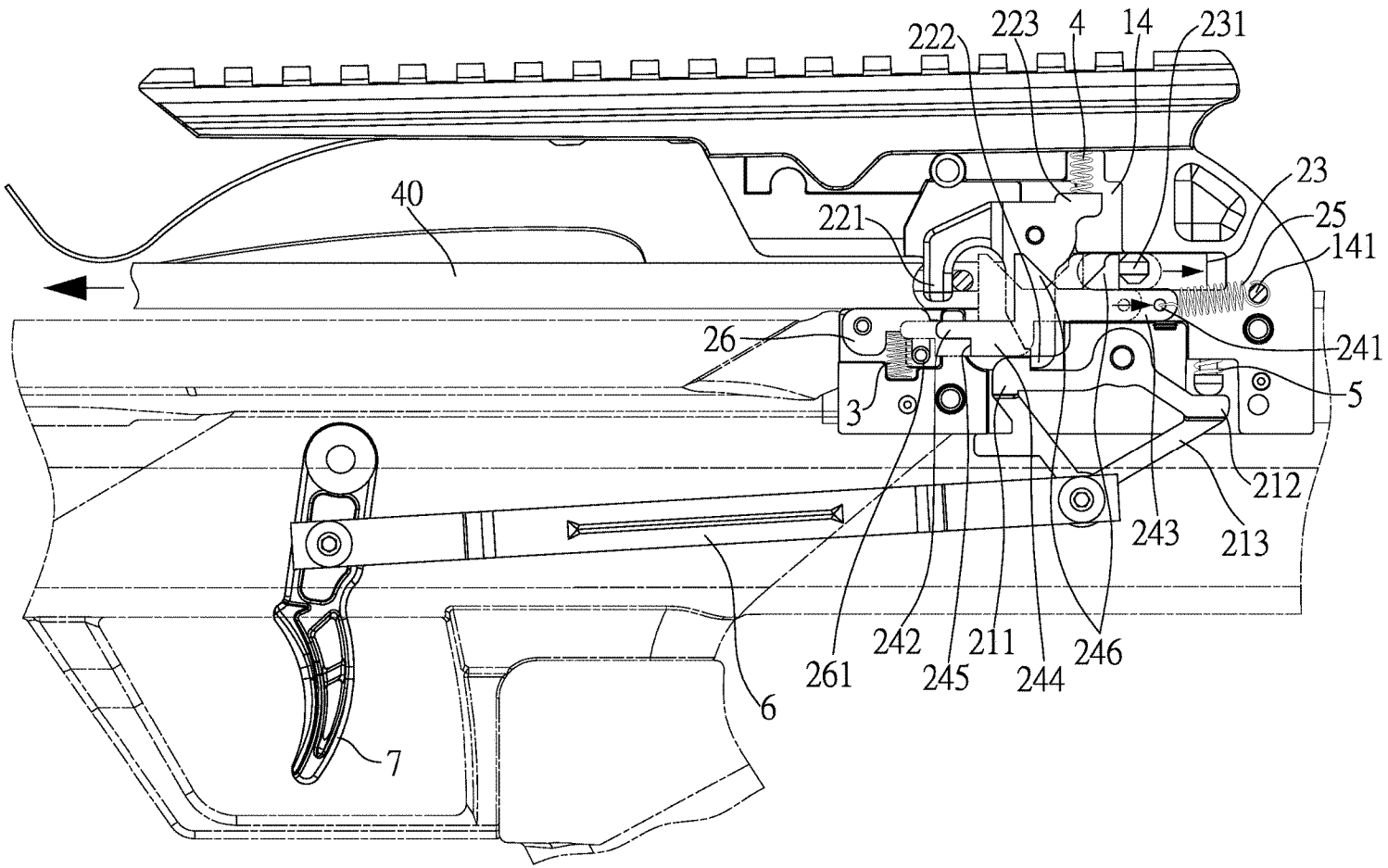
FIG. 9 shows that safety member is moved toward the second end of the case and a new arrow is replaced, the resilient member pulls the transmission plate to move to deactivate the restriction to the positioning member.
Figure 10:
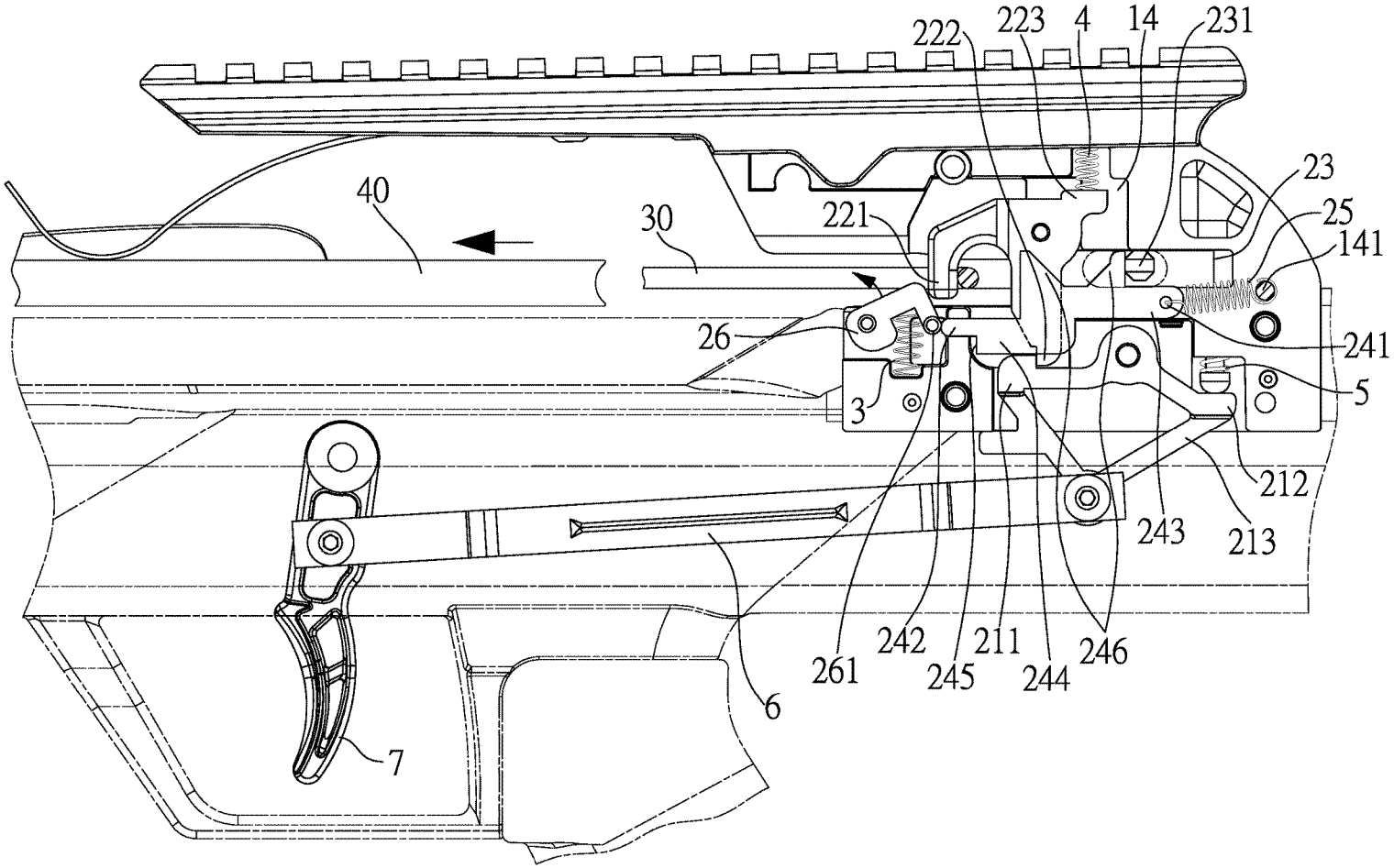
FIG. 10 shows that when the arrow is removed, the positioning member is pivoted and returns to its initial position.
Figure 11:
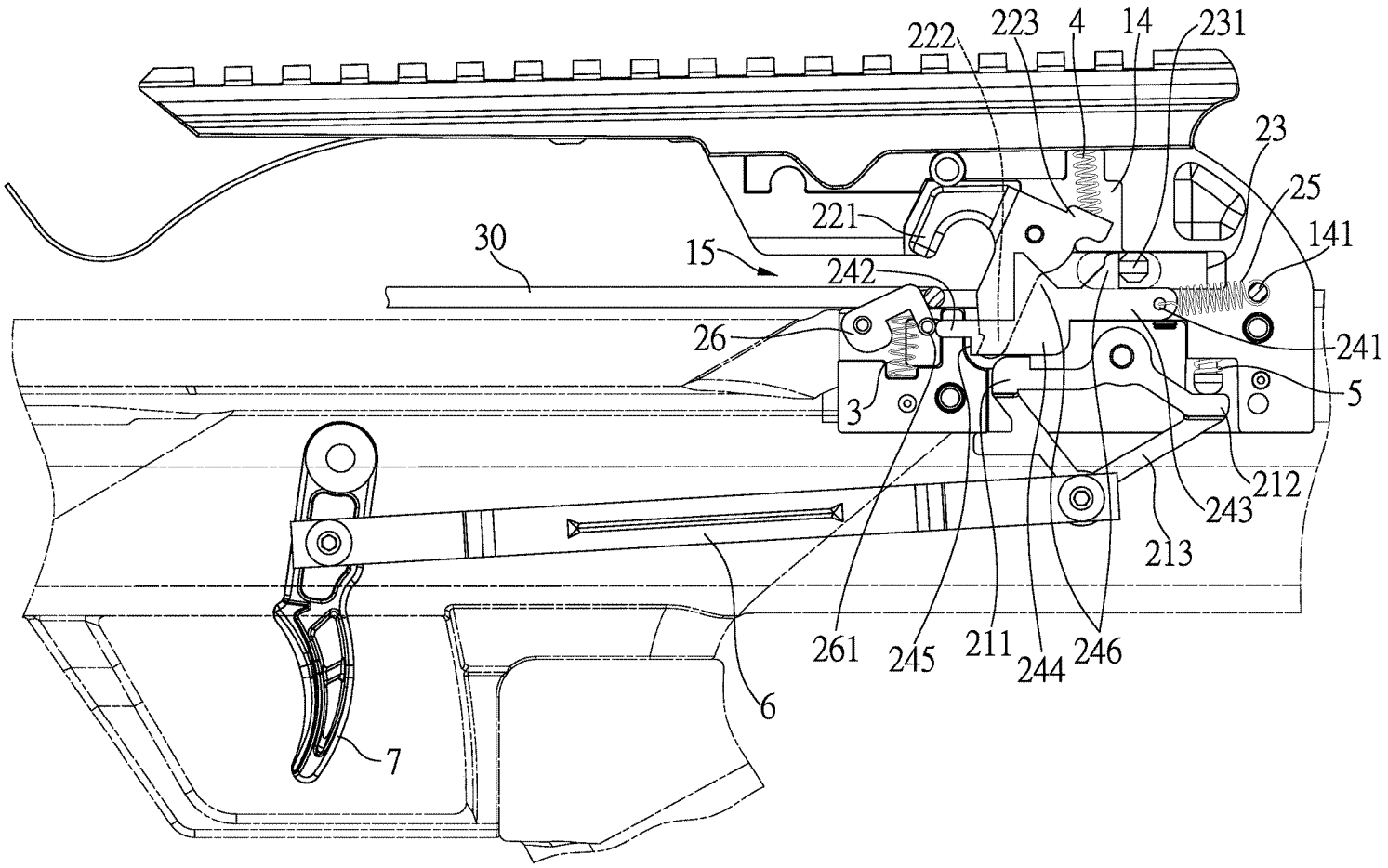
FIG. 11 shows that the string is unintentionally disengaged from the shooting member and contacts the positioning member.

When in the ready-to-shoot mode and proceeding replacement of arrows 40, the safety member 23 is moved from the second end 12 toward the first end 11 of the case 1, the protrusion 231 pushes the transmission plate 24 and the transmission plate 24 deactivates restriction to the safety member 23 and pulls resilient member 25. This is the ready-to-shoot mode as shown in FIG. 8. As shown in FIG. 9, if the user decides to change a new arrow 40, the first action is to activate the safety feature to prevent shooting, the safety member 23 needs to be moved from the first end 11 toward the second end 12 of the case 1, and the activating member 21 is restricted from pivoting to prevent unexpectedly shooting. Under this status, the safety member 23 does not contact the transmission plate 24, and the transmission plate 24 is pulled by the resilient member 25 from the first end 11 toward the second end 12. The movement of the transmission plate 24 deactivates the restriction of pivoting to the positioning member 26 as shown in FIG. 10. Therefore, the current arrow 40 can be removed from the crossbow 10, the positioning member 26 is pivoted to protrude beyond the notch 15 to prevent the string 30 to bounce forward as shown in FIG. 11. Therefore, the resilient member 25 pulls the transmission plate 24 ensures that the replacement of the arrow 40 is safe.

Figure 3:
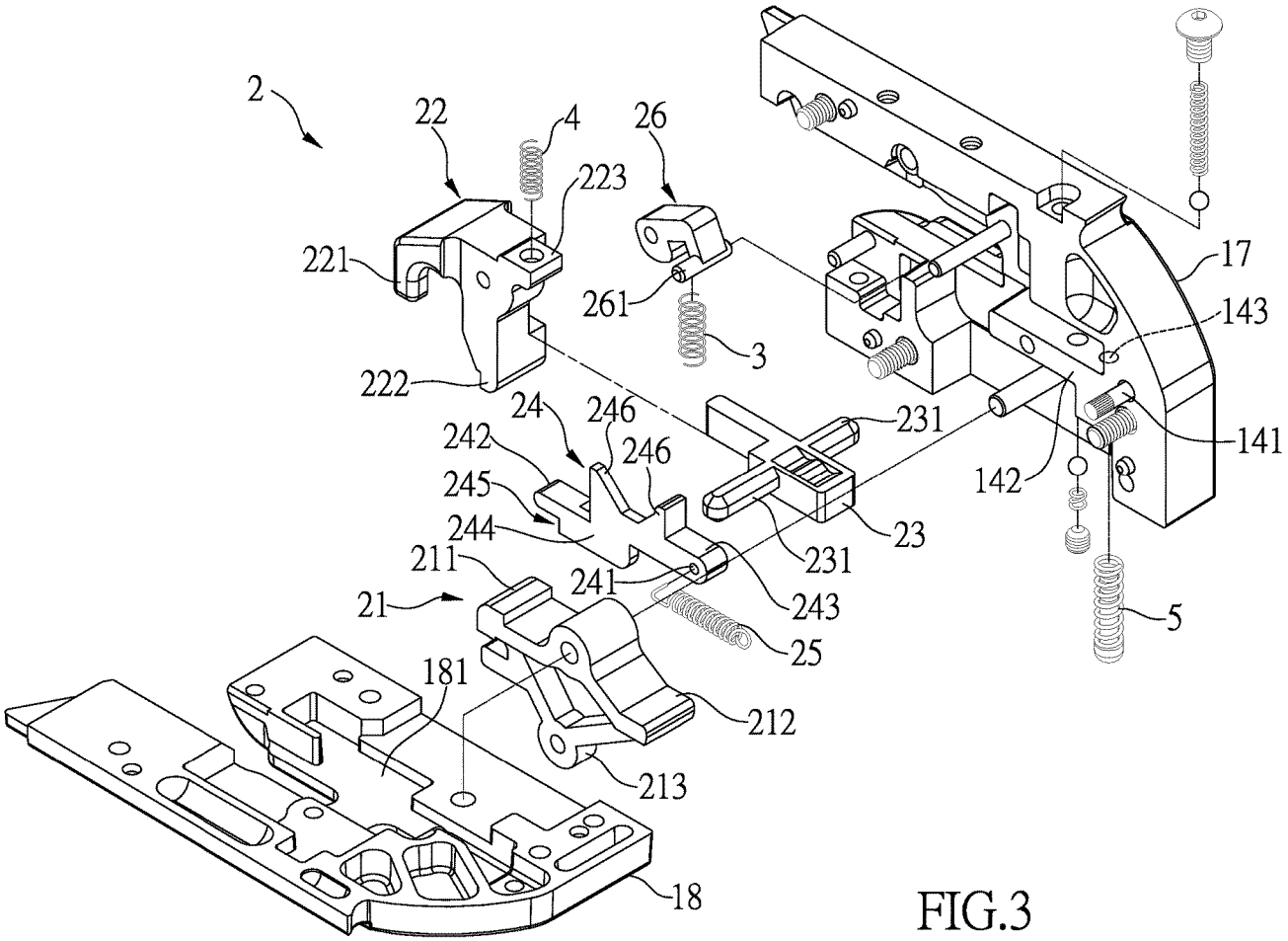
FIG. 3 is an exploded view of the safety device of the present invention.
Figure 4:
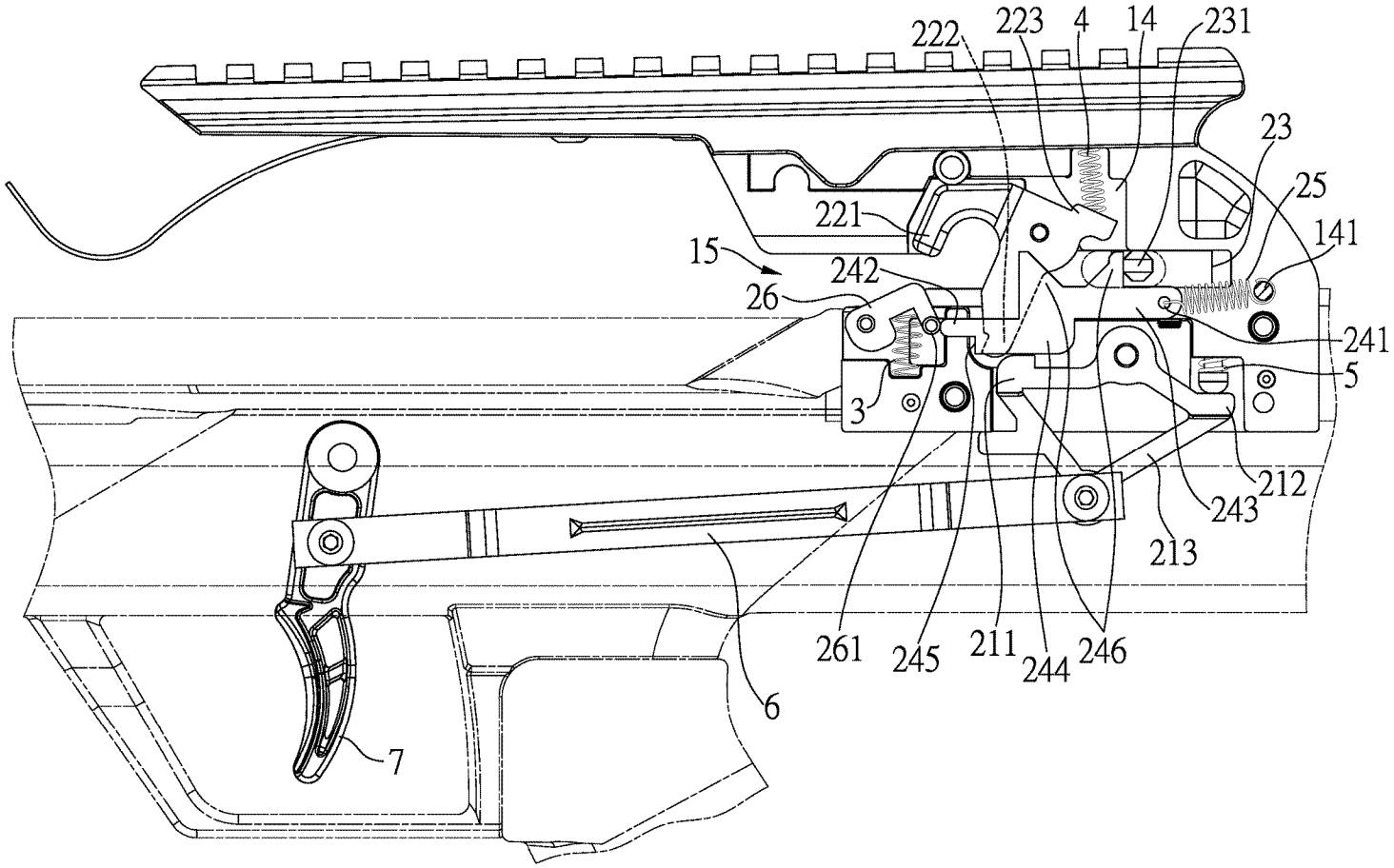
FIG. 4 shows the side view of the inside of the safety device of the present invention installed to a crossbow.

Specifically, the case 1 includes a first part 17 and a second part 18 which is connected to the first part 17. The second part 18 includes a recess 181 in which the transmission plate 24 is slidably received. The transmission plate 24 is restricted its direction of movement by the protrusions 231 extending through the elongate holes 16, and the recess 181 also ensure that the safety member 23 is movable and does not drop into the room 14 to affect the operation of the crossbow 10, as shown in FIG. 3. The transmission plate 24 includes a front section 242, a rear section 243 and a middle section 244 that is formed between the front and rear sections 242, 243. The front section 242 includes a shoulder 245 which restricts the positioning member 26 to pivot before the arrow 40 is installed into the crossbow 10. The passage 241 is defined through the rear section 243. The middle section 244 includes at least one push plate 246 extending from the top thereof. In this embodiment, there are two push plates 246 which are arranged in a V-shaped arrangement. One of the protrusions 231 of the safety member 23 that is located close to the safety member 23 pushes the push plate 246. As shown in FIGS. 3, 4, 6 and 8, when the user wants to secure the string 30, the string 30 is pulled to contact the push plate 246 that is located at the middle section 244 and located close to the notch 15, and the other push plate 246 of the transmission plate 24 that is located close to the safety member 23 contacts the protrusion 231. Therefore, the transmission plate 24 and the safety member 23 can be moved from the first end 11 toward the second end 12.

When the arrow 40 is to be shot, the safety member 23 is moved from the second end 12 toward the first end 11, and the protrusion 231 pushes the push plate 246 that is located close to the safety member 11 so that the transmission plate 24 moves from the second end 12 toward the first end 11. It is noted that the push plate 246 and the transmission plate 24 are in contact with each other and moved together in the two different actions described above. The user simply controls the movement of the transmission plate 24 by operating the protrusion 231 of the safety member 23, and the resilient member 25 pulls the restriction plate 24 as shown in FIG. 9 when the safety member 23 is moved from the first end 11 toward the second end 12 to ensure the user's safety during replacing arrows 40.

Figure 5:
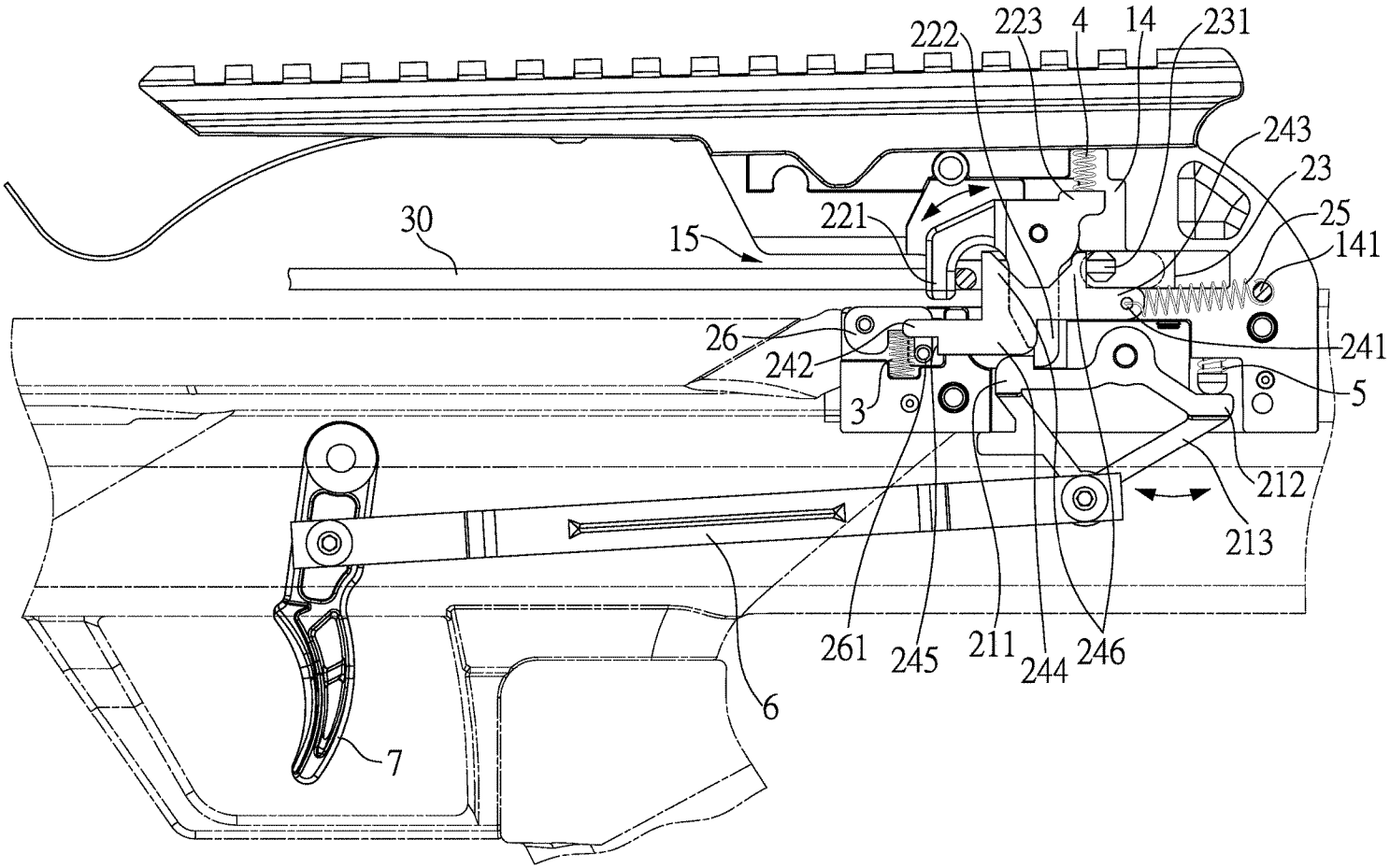
FIG. 5 shows that the activating member is pivoted, and the shooting member is pivoted to position the string.
Figure 6:
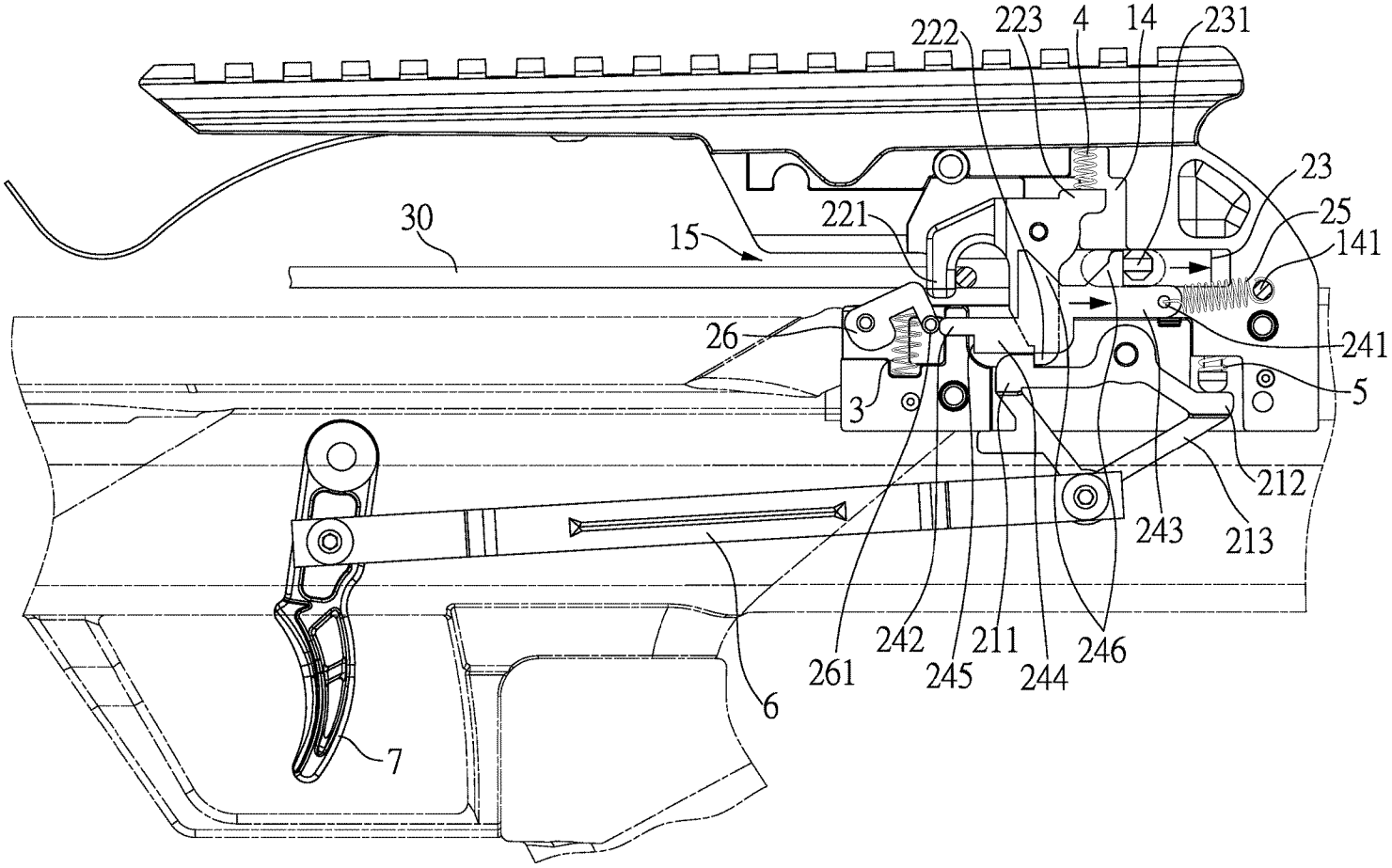
FIG. 6 shows that the transmission plate is moved toward the second end of the case, and the safety member is moved to restrict the activating member.
Figure 7:
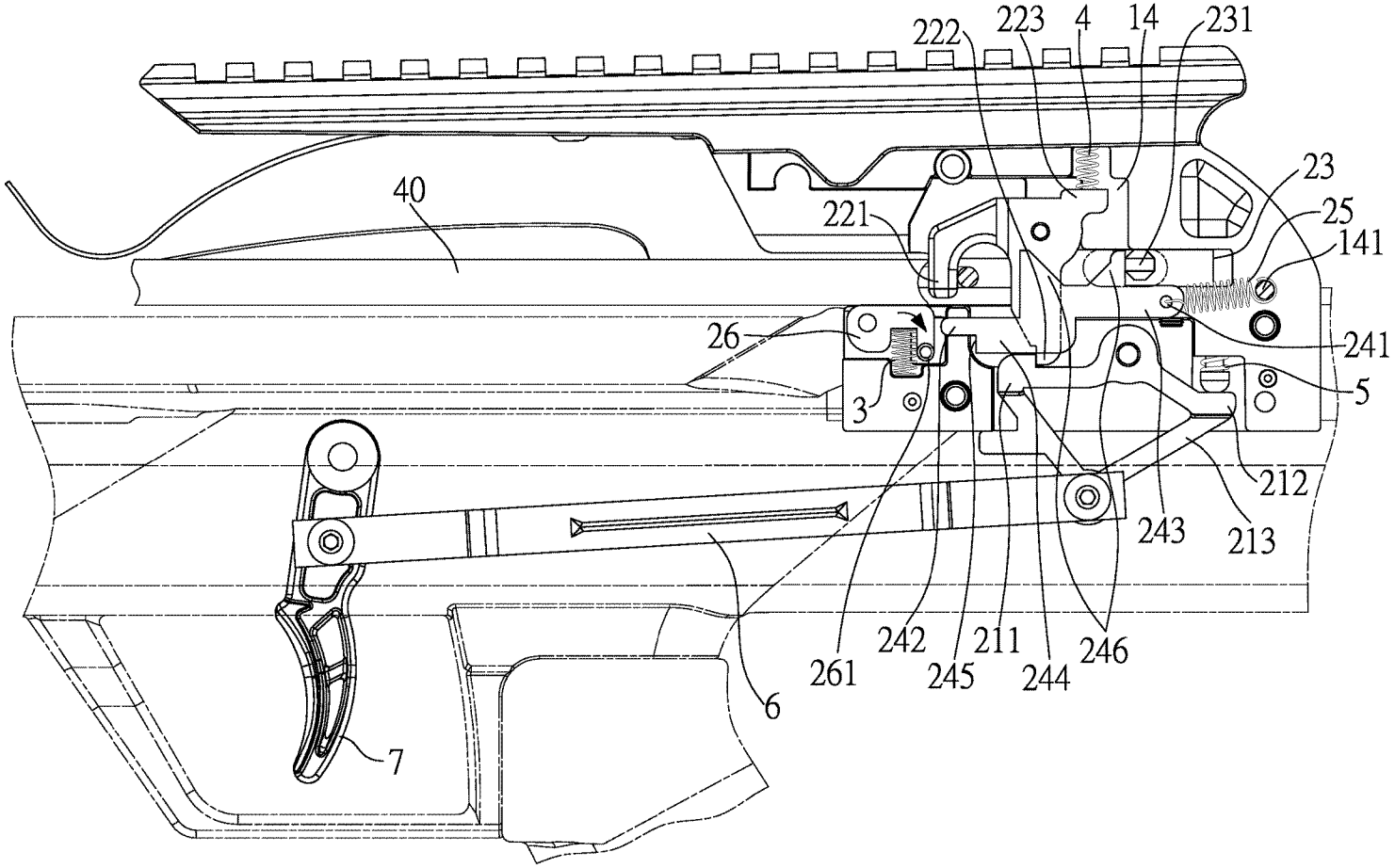
FIG. 7 shows that an arrow is positioned to the crossbow.

The positioning member 26 has the first end thereof pivotably connected to the inside of the room 14, and the second end of the positioning member 26 has a bar 261 transversely connected thereto. A recessed area is formed in the underside of the positioning member 26 and located between the first and second end thereof. The bar 261 and the transmission plate 241 are located on the same side with regarding to the safety member 23. A recovery spring 3 is biased between the inside of the room 14 and the recessed area in the underside of the positioning member 26. As shown in FIGS. 3 and 5, when the transmission plate 24 moves toward the positioning member 26, the bar 261 is engaged with the shoulder 245. The positioning member 26 compresses the recovery spring 3 to store energy, and the arrow 40 can be installed to the crossbow 10. When the transmission plate 24 moves toward the safety member 23, the bar 261 is not restricted by the shoulder 245, the positioning member 26 does not compress the recovery spring 3 which then pushes the positioning member 26 toward the notch 15 so that a portion of the positioning member 26 protrudes beyond the notch 15 to prevent the string 30 from bouncing forward to injure the user or to shoot the arrow 40.

As shown in FIGS. 3 to 7, the shooting member 22 includes a first hook 221, a second hook 222 and a push portion 223. The first hook 221 partially protrudes beyond the notch 15 so as to hook the string 30 at the ready-to-shoot mode. The second hook 222 contacts a restriction end 211 of the activating member 21 to restrict the shooting member 22 from pivoting when the first hook 221 of the shooting member 22 hooks the string 30. The push portion 223 is located above the safety member 23. A spring 4 is biased between the push portion 223 and inside of the room 14. When the shooting member 22 hooks the string 30 by the first hook 221, the push portion 223 compresses the spring 4. When the restriction end 211 deactivates the second hook 222, the spring 4 releases its stored energy to push the push portion 223 to return the shooting member 22.

Figure 2:
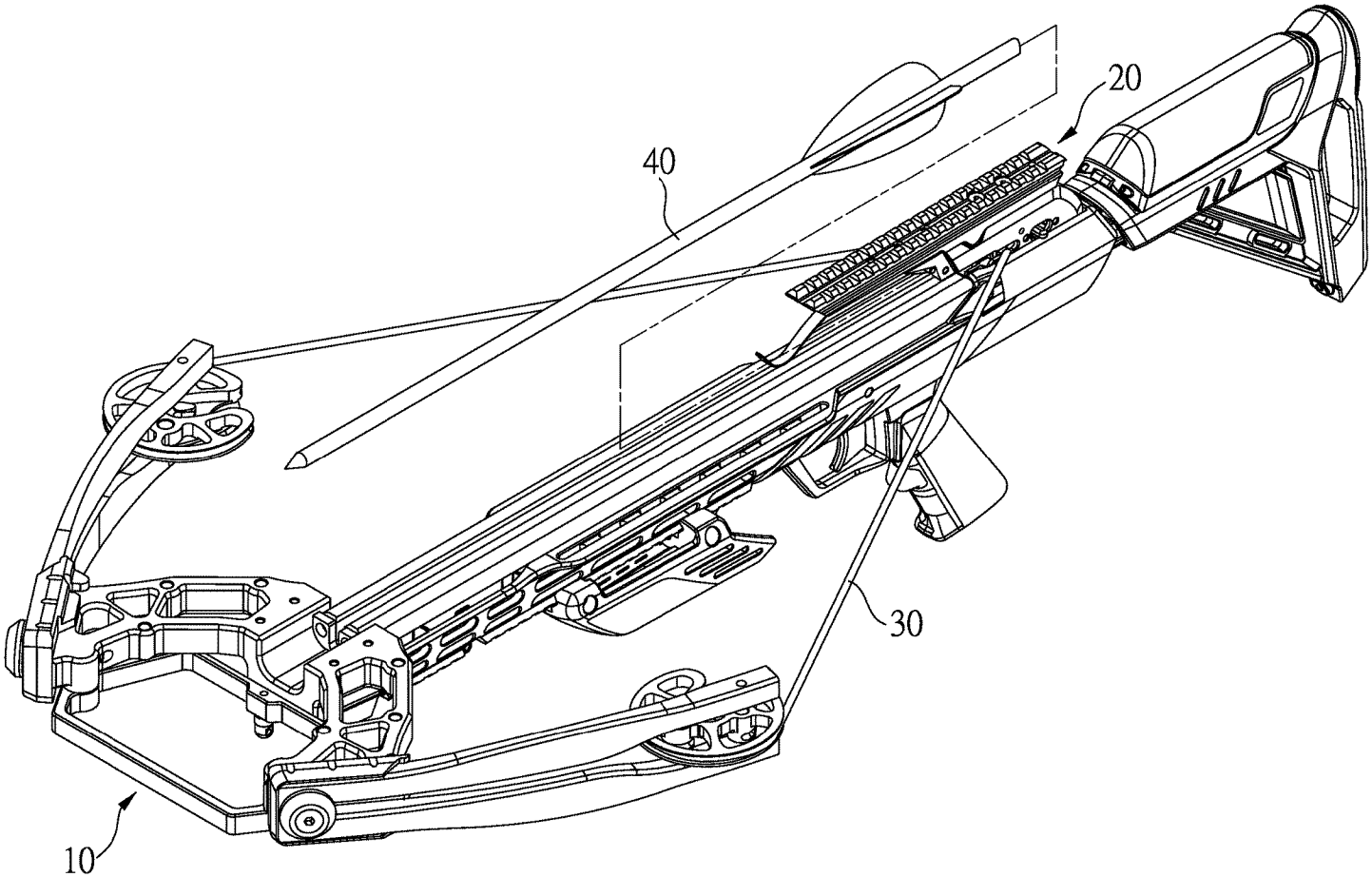
FIG. 2 shows that the safety device of the present invention is connected to a crossbow.

The activating member 21 has the restriction end 211 on the first end thereof and a push end 212 on the second end thereof. A connection end 213 is formed between the restriction end 211 and the push end 212. A block 142 protrudes from the inside of the room 14, and a distance is formed between the block 142 and the push end 212. The block 142 includes a bore 143. A restriction spring 5 has the first end thereof resiliently protrudes beyond the bore 143, and the second end of the restriction spring 5 contacts the push end 212. As shown in FIGS. 3 to 8, when the user sets the string 30, the restriction end 211 is engaged with the second hook 222 by pivoting eh activating member 21. The string 30 moves the transmission plate 24, and the transmission plate 24 pushes the safety member 23 to move from the first end 11 toward the second end 12 of the case 1, and the safety member 23 covers up the bore 143 so that the restriction spring 5 cannot protrudes from the bore 143 to prevent the activating member 21 from pivoting and to avoid unexpectedly shooting. Besides, the connection end 213 is pivotably connected with a link 6 which is pivotably connected with a trigger 7. As shown in FIG. 2, when the trigger 7 is pulled, the link 6 drives the activating member 21 to pivot to shoot the arrow 40.

The safety feature >of the present invention is that the safety member 23 has to be moved from the first end 11 toward the second end 12 to restrict the activating member 21 from pivoting to prevent unintentionally shooting when replacing arrows 40 at the ready-to-shoot status of the crossbow 10. In the meanwhile, the resilient member 25 drives the transmission plate 24 from the first end 11 to the second end 12 to deactivate the restriction to the positioning member 26 by the shoulder 245. The user then may replace the arrow 40. When the arrow 40 is removed from the crossbow 10, the positioning member 26 protrudes beyond the notch 15 due to the force from the recovery spring 3, therefore, if the string 30 is unintentionally disengaged from the first hook 221, the string 30 is stopped by the portion of the positioning member 26 that protrudes beyond the notch 15.

While we have shown and described the embodiment in accordance with the present invention, it should be clear to those skilled in the art that further embodiments may be made without departing from the scope of the present invention.

What is claimed is:

1. A safety device connected to a shooting device of a crossbow, comprising;

a case having a first end, a second end and a bottom connected between the first and second ends, a room defined in the case, a notch defined in the first end and communicating with the room, two elongate holes respectively defined through two walls of the case and communicating with the room, an opening defined in the bottom and communicating with the room;

a shooting unit located in the room and having an activating member, a shooting member, a safety member, a transmission plate, a resilient member and a positioning member, the activating member pivotably located in the room and having a first end thereof protruding beyond the opening, the shooting member pivotably located in the room and being pivotable to contact a second end of the activating member, a gap being formed between the activating member and the shooting member when the shooting member is not pivoted, the safety member having two protrusions which respectively extend beyond the elongate holes of the case;

the transmission plate slidably located in the room and partially located beneath the shooting member, the transmission plate being moved by movement of the safety member, the transmission plate having a passage defined transversely through a first end thereof, the resilient member a first end thereof hooked to the passage, a second end of the resilient member connected to a rod extending from an inside of the room;

the positioning member located in the room and beside the notch, the positioning member being not pivotable to form a ready-to-shoot mode when the transmission plate moves toward the positioning member, the positioning member being pivoted and protruding beyond the notch when the transmission plate moves away from the positioning member, the safety member moving toward the first end of the case and pushing the transmission plate to move so as to pull the resilient member to store energy, and wherein when changing arrows during that the shooting device is in the ready-to-shoot mode, the safety member is moved toward the second end of the case, the transmission plate deactivates restriction to the safety member and moves toward the second end of the case by the resilient member so that the transmission plate deactivates restriction to the positioning member, and the positioning member pivots toward the notch to prevent a string from bouncing forward.

2. The safety device connected to a shooting device of a crossbow as claimed in claim 1, wherein the case includes a first part and a second part which is connected to the first part, the second part includes a recess in which the transmission plate is slidably received.

3. The safety device connected to a shooting device of a crossbow as claimed in claim 2, wherein the transmission plate includes a front section, a rear section and a middle section formed between the front and rear sections, the front section includes a shoulder which restricts the positioning member to pivot, the passage is defined through the rear section, the middle section includes at least one push plate extending from a top thereof, one of the protrusions of the safety member pushes the at least one push plate, a displacement between the safety member and the transmission plate is used to set the ready-to-shoot mode, or to deactivate the ready-to-shoot mode, the safety member moves toward the second end of the case and the resilient member pulls the transmission plate so as to pivot the positioning member such that a portion of the positioning member protrudes beyond the notch to restrict the string from bouncing forward.

4. The safety device connected to a shooting device of a crossbow as claimed in claim 3, wherein the positioning member has a first end thereof pivotably connected to the inside of the room, a second end of the positioning member has a bar transversely connected thereto, the bar and the transmission plate are located on the same side with regarding to the safety member, a recovery spring is biased between an inside of the room and an underside of the positioning member, when the transmission plate moves toward the positioning member, the bar is engaged with the shoulder, the positioning member compresses the recovery spring to store energy, when the transmission plate moves toward the safety member, the positioning member does not compress the recovery spring which then pushes the positioning member so that a portion of the positioning member protrudes beyond the notch.

5. The safety device connected to a shooting device of a crossbow as claimed in claim 4, wherein the shooting member includes a first hook, a second hook and a push portion, the first hook partially protrudes beyond the notch so as to hook the string at the ready-to-shoot mode, the second hook contacts a restriction end of the activating member to restrict the shooting member from pivoting when the first hook of the shooting member hooks the string, the push portion is located above the safety member, a spring is biased between the push portion and an inside of the room, the spring pivots the shooting member.

6. The safety device connected to a shooting device of a crossbow as claimed in claim 5, wherein the activating member has the restriction end on a first end thereof and a push end on a second end thereof, a connection end is formed between the restriction end and the push end, a block protrudes from the inside of the room, a distance is formed between the block and the push end, the block includes a bore, a restriction spring has a first end thereof resiliently protrudes beyond the bore, a second end of the restriction spring contacts the push end, when the safety member moves toward the second end of the case and covers up the bore, the activating member is restricted from pivoting, the connection end is pivotably connected with a link which is pivotably connected with a trigger, when the trigger is pulled, the link drives the activating member to pivot.

* * * * *